United States Patent [19]

Pyrozyk

[11] Patent Number: 4,938,621

[45] Date of Patent: Jul. 3, 1990

[54] HAIR BRUSH AND MOUSSE DISPENSING DEVICE

[75] Inventor: Ronald R. Pyrozyk, Naramata, Canada

[73] Assignee: Okanagan House Inc., Penticton, Canada

[21] Appl. No.: 189,647

[22] Filed: May 3, 1988

[51] Int. Cl.[5] ..... A46B 11/06; A47L 13/22

[52] U.S. Cl. ..... 401/289; 132/112

[58] Field of Search ..... 401/190, 286, 280, 282, 401/285, 288, 289, 290; 132/112, 116, 142, 313; 222/402.1, 402.12, 402.13, 402.21, 182

[56] References Cited

U.S. PATENT DOCUMENTS

| | | | |
|---|---|---|---|
| 2,775,372 | 12/1956 | Jordan | 222/402.13 |
| 3,184,781 | 5/1965 | Hoxie | 401/190 X |
| 3,388,958 | 6/1968 | Modla | 401/190 X |
| 3,964,501 | 6/1976 | Matchett . | |
| 4,209,027 | 6/1980 | Morganroth . | |
| 4,368,376 | 1/1983 | Andis | 132/142 X |
| 4,533,273 | 8/1985 | Obata et al. | 401/286 X |
| 4,557,619 | 12/1985 | DeVincentis . | |
| 4,753,547 | 6/1988 | Dodero | 401/190 |
| 4,815,637 | 3/1989 | Nellis | 222/402.12 |

FOREIGN PATENT DOCUMENTS

| | | | |
|---|---|---|---|
| 2236448 | 2/1975 | France | 401/190 |
| 88/07339 | 10/1988 | PCT Int'l Appl. . | |
| 999593 | 6/1965 | United Kingdom | 401/190 |
| 2184789 | 7/1987 | United Kingdom | 401/190 |

*Primary Examiner*—Richard J. Apley
*Assistant Examiner*—D. F. Crosby
*Attorney, Agent, or Firm*—Bull, Housser & Tupper

[57] ABSTRACT

A hair brush and mousse dispensing device comprises a body portion having a top end and a bottom end. The body portion includes a mechanism for connecting the device to a pressurized mousse dispensing cylinder, the mechanism for connecting being adjacent the bottom end. The top end of the body portion has a styling brush including a plurality of bristles or teeth spaced therearound. The device includes a mechanism for dispensing the mousse from the device which is disposed between a dispensing tip of the pressurized mousse dispensing cylinder and a dispensing aperture in the body portion. The device further includes a mechanism for providing access to the dispensing tip of the pressurized mousse dispensing cylinder.

16 Claims, 4 Drawing Sheets

HAIR BRUSH AND MOUSSE DISPENSING DEVICE

BACKGROUND OF THE INVENTION

The present invention relates to a hair brush and mousse dispensing device.

Several devices have been invented for dispensing fluids through a hair treatment device. For example, U.S. Pat. No. 4,557,619 (De Vincentis) discloses a hairbrush and aerosol spray assembly. U.S. Pat. No. 3,964,501 (Matchett) discloses a hair grooming apparatus for dispensing a liquid and U.S. Pat. No. 4,209,027 (Morganroth) discloses hair treatment devices and packages therefor. The prior art does not appear to disclose a device for dispensing hair mousse through a hairbrush as described by the present invention.

SUMMARY OF THE INVENTION

The devices disclosed in the prior art generally teach the dispensing of liquid or hairspray through a hair treatment device such as a brush. None of the prior art devices would appear to indicate the dispensing of mousse through a hair treatment device. Mousse tends to be a foam-like substance which does not lend itself to easy flow through any of the devices disclosed in the prior art. The present invention overcomes the problem of making the mousse flow easily from a dispensing cylinder through a passageway and out of a hair treatment device.

Without the benefit of the present invention, mousse is generally applied to one's hair either by spraying the mousse directly into the hair or by depositing it into one's hands for subsequent application to the hair. Spraying the mousse directly results in a high concentration of the mousse in a small area. Several strokes of a hairbrush or rubbing one's hands in the hair is required to distribute the mousse. Distribution of the mousse using one's hands can be rather messy and undesirable.

The present invention overcomes the problem of distributing mousse by providing a hairbrush and mousse dispensing device which eliminates an otherwise present need to distribute mousse using one's hands. The present invention also overcomes the problem of mousse being concentrated in a small area of one's hair.

The present invention provides a hairbrush and mousse dispensing device comprising a body portion having a top end and a bottom end. The body portion includes means for connecting the device to a pressurized mousse dispensing cylinder, the means for connecting being adjacent the bottom end. The device also includes a styling brush including a plurality of bristles or teeth spaced therearound, the styling brush being adjacent the top end of the body portion. The device also includes means for dispensing the mousse from the device, the means for dispensing being disposed between a dispensing tip of the pressurized mousse dispensing cylinder and a dispensing aperture in the body portion. The device further includes means for providing access to the dispensing tip of the pressurized mousse dispensing cylinder.

The means for connecting includes an annular base at the bottom end of the body portion and a plurality of inwardly extending retaining projections on the annular base, the retaining projections being adapted to engage with the pressurized mousse dispensing cylinder adjacent the dispensing tip.

The means for providing access includes arched access apertures extending upwardly from the annular base. The means for dispensing includes a rigid conduit and a flexible conduit, the conduits being connected together, the rigid conduit being connected to the dispensing aperture and the flexible conduit being connected to the dispensing tip of the pressurized mousse dispensing cylinder.

DESCRIPTION OF THE PREFERRED EMBODIMENTS

Figures 1, 2:
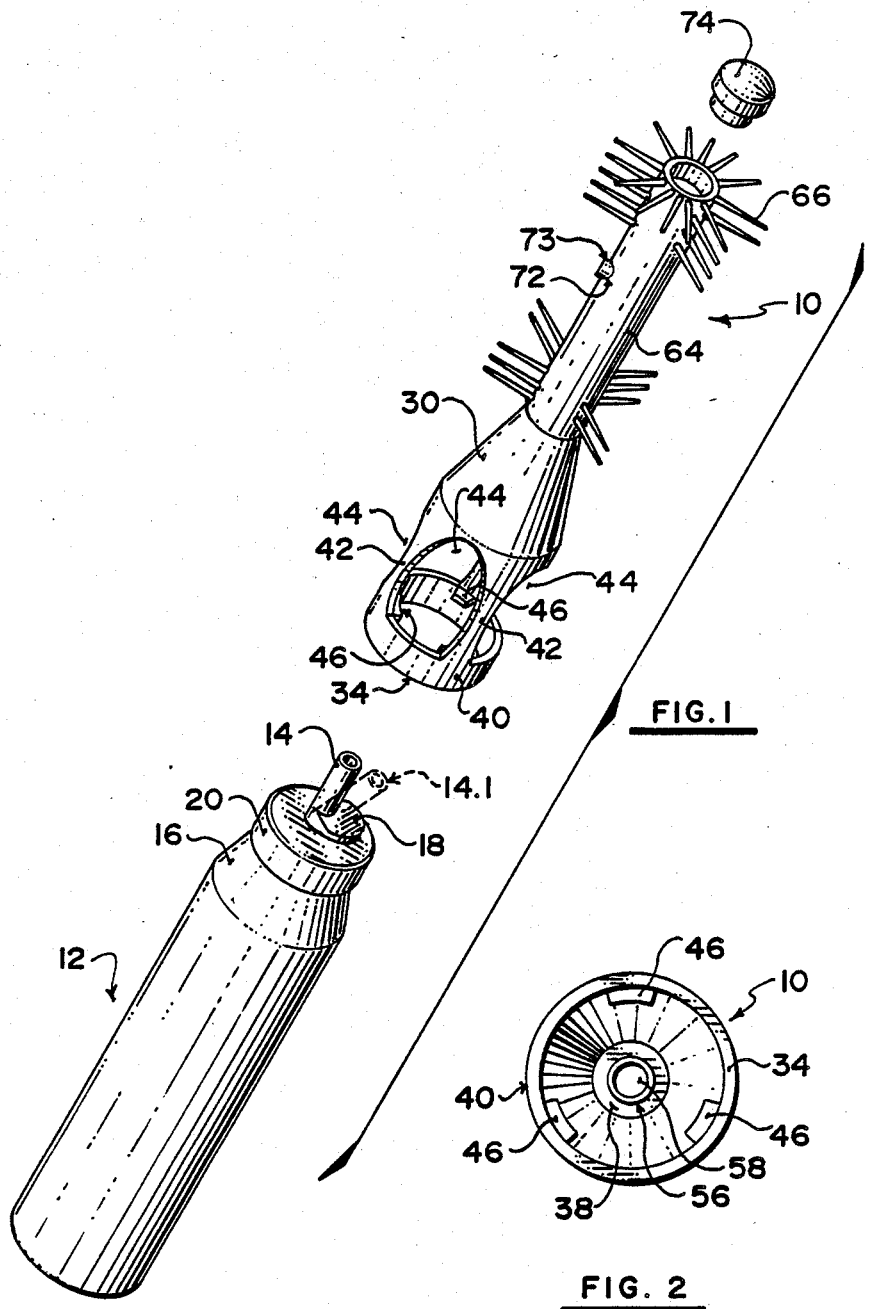
FIG. 1 is a simplified fragmented perspective of a hair brush and mousse dispensing device of the present invention.
FIG. 2 is a simplified bottom view of the hair brush and mousse dispensing device of FIG. 1.

FIG. 1 shows a conventional pressurized mousse dispensing cylinder 12 which includes a mousse dispensing tip 14 adjacent a dispensing end 16. The cylinder 12 includes a trigger mechanism 18 which, when activated by pressing with one's finger or thumb, swings the tip 14 to an inclined position 14.1 (broken outline) and opens a valve mechanism within the cylinder 12 so that the mousse contained therein can exit through the dispensing tip 14. The cylinder 12 also includes an annular rim 20 adjacent the dispensing end 16.

Figure 3:
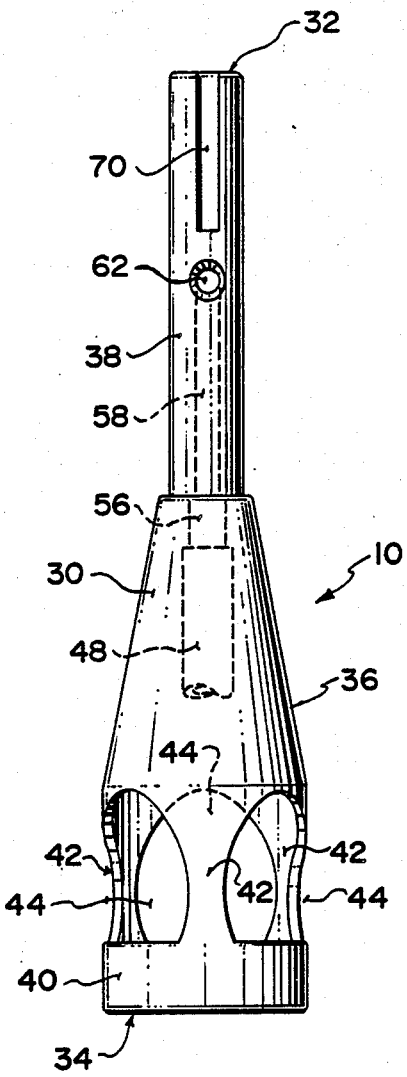
FIG. 3 is a side view of the mousse dispensing device of FIGS. 1 and 2 with the styling brush removed.

Referring to FIG. 3 a hair brush and mousse dispensing device of the present invention is shown generally at 10. The device includes a body portion 30 which has a top end 32 and a bottom end 34. The body portion 30 includes a first portion 36 and a second portion 38. The second portion 38 is cylindrical and extends upwardly from the first portion 36. The first portion 36 is an upwardly tapering portion which extends from an annular base 40.

The annular base 40 is attached to three legs 42 which form three arch shaped apertures 44 equidistantly spaced around the first portion 36. The apertures act as means for providing access to the dispensing tip 14 of the cylinder 12.

Figure 4:
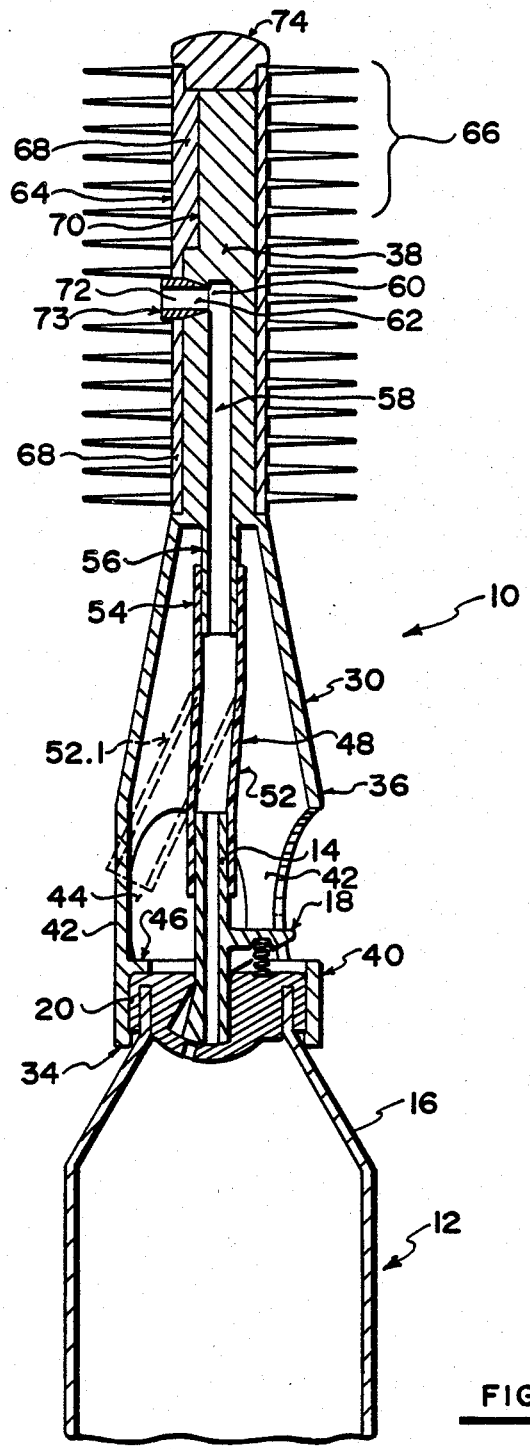
FIG. 4 is a simplified cross-sectional view of the hair brush and mousse dispensing device of FIGS. 1–3, with the styling brush thereon, showing the trigger mechanism in the rest position.
Figure 5:
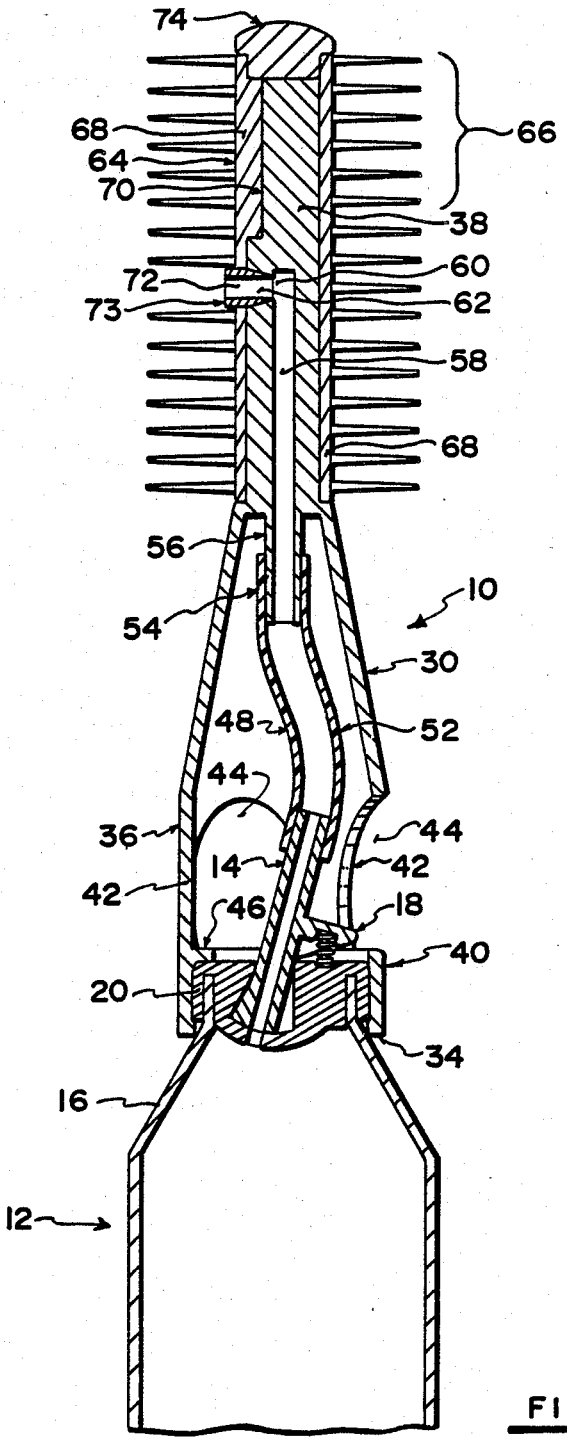
FIG. 5 is a simplified cross-sectional view of the hair brush and mousse dispensing device showing the trigger mechanism in the operating position.

Referring to FIG. 2, the annular base 40 includes three inwardly extending retaining projections 46 equidistantly spaced around the top of annular base 40. The annular base and the three inwardly extending retaining projections 46 comprise means for connecting the device 10 to the pressurized mousse dispensing cylinder 12. Referring to FIGS. 4 and 5, the inwardly extending retaining projections 46 are located on the annular base 40 such that when the device 10 is installed on the mousse dispensing cylinder 12, the projections lie on the top surface of the annular rim 20 to reduce rocking.

As seen in FIG. 4, the device 10 also includes a flexible conduit 48 made of material such as latex rubber or live rubber selected for its ability to resist "kinking" or flattening when bent. The conduit is pre-formed to have a bend causing a first flexible portion 52 of the conduit to extend approximately 25 degrees off axis of a second flexible portion 54 as shown in broken outline at 52.1 in a freely supported state. The first flexible portion 52 of the flexible conduit has an inside diameter allowing it to be engaged over the dispensing tip 14 of the mousse dispensing cylinder. The second flexible portion has an inside diameter allowing it to be engaged over a rigid conduit 56 extending from the second portion 38 of the device 10. The rigid conduit 56 communicates with a passageway 58 having a right angled portion 60. The right angled portion extends laterally through the second portion forming an aperture 62 as shown in FIG. 3.

Referring again to FIGS. 4 and 5, the device 10 also includes a styling brush 64 having a plurality of bristles or teeth 66 spaced therearound. The styling brush 64 is cylindrical having an inside diameter slightly larger than the outside diameter of the second portion 38. The styling brush 64 is thus adapted to slidably engage with the second portion 38.

The styling brush 64 has a longitudinal spline 68 which engages with a groove 70 which extends along the second portion 38 to a point adjacent the aperture 62, the groove being shown in FIG. 3 and the spline being shown in FIGS. 4 and 5. When the styling brush is slidably engaged with the second portion 38, the spline and groove maintain registration of the styling brush relative to the second portion 38. Registration is maintained such that an opening 72 in the styling brush is aligned with the aperture 62 in the second portion 38. A collar 73 is inserted and held by a pressure fit in the opening 72 of the styling brush. The collar provides an extension of the passageway 58, to conduct the mousse into the bristles of the styling brush. The device 10 further includes a locking cap 74 to lock the styling brush 64 onto the second portion 38.

OPERATION

Referring to FIG. 4, operation of the device is achieved by placing the apparatus onto the dispensing end 16 of the cylinder 12 so that the inwardly extending retaining projections 42 on the bottom end 34 lie on the top surface of the annular rim 20 of the cylinder 12. The access apertures 44 in the first portion 36 enable the first flexible portion 52 of the flexible conduit 48 to be connected onto the dispensing tip 14. By employing the trigger mechanism 18, as shown in FIG. 5, the mousse will exit the dispensing tip 14, flow through the flexible and rigid conduits 48 and 56, through the passageway 58 and will exit through the opening 72. The mousse is therefor within the bristles or teeth 66 which facilitate disbursement of the mousse in a person's hair.

The flexible conduit 48 is pre-formed at a 25 degree off axis angle in order to adapt to the displacement of the dispensing tip 14 when the trigger mechanism 18 is employed. Thus the device is installed onto the cylinder 12 in the orientation shown in FIG. 4. The pre-formed flexible conduit is shown prior to connection to the dispensing tip in broken outline at 52.1. The conduit is shown connected to the dispensing tip in solid lines. In the rest position, the dispensing tip 14 and the rigid conduit 56 are generally axially parallel but are not axially aligned. Due to the misalignment of the dispensing tip with the rigid conduit 56, a straight, flexible tube would tend to present a bias tending to open the trigger mechanism and allow mousse to exit the cylinder when the trigger mechanism is in the rest position. The pre-formed conduit provides a slight bias on the trigger mechanism tending to keep the mechanism in its closed position, the bias being caused by the resilient conduit being out of alignment with the dispensing tip. This serves to prevent mousse from leaving the cylinder 12 when the trigger mechanism is in the closed position. The flexible conduit is of appropriate dimensions and resilience to ensure that no kinking of the material can occur.

When the trigger mechanism 18 is operated as shown in FIG. 5, the dispensing tip 14 moves through an angle of approximately 25 degrees, thereby moving the flexible conduit 48 from its rest position and allowing mousse to flow easily through the device and out of the opening 72. Varying the degree angular movement in the dispensing tip 18 varies the amount of flow of mousse through the device 10.

In an alternative embodiment, the means for dispensing the mousse from the device could include a single conduit having a rigid portion and a flexible portion.

It is to be understood that the invention is not confined to the particular construction and arrangement of parts as herein illustrated and described, but embraces all such modified forms thereof as come within the scope of the following claims.

What is claimed is:

1. A hair brush/mousse dispensing device for use with a pressurised mouse dispensing cylinder having a generally axially aligned dispensing tip and a trigger mechanism adjacent a dispensing end of the cylinder, actuation of the trigger mechanism swinging the dispensing tip to an inclined position to open a valve controlling flow from the cylinder, the device comprising:

(a) a body portion having a first portion and a second portion, the first portion having a generally cylindrical side wall with an open end remote from the second portion and connecting means for releasably connecting the open end of the device to the dispensing end of the pressurized mousse dispensing cylinder, the second portion having a dispensing aperture and a passageway communicating therewith, the passageway being disposed generally axially of the device;

(b) a styling brush including a plurality of spaced apart bristles, the styling brush being axially moveable relative to, and detachably mounted on, the second portion of the body portion and communicating with the dispensing aperture;

(c) conduit means for receiving the mousse, the conduit means having an elongated flexible conduit having an first end portion with a diameter which is releasably connectable to the dispensing tip of the pressurized mousse dispensing cylinder, the conduit having an second end portion connected to the passageway for communication with the dispensing aperture in the body portion, the flexible conduit being preformed to extend at an angle to the longitudinal axis of the body portion when disconnected from the dispensing tip, and being sufficiently flexible to permit lateral movement thereof relative to the second portion to engage the tip so that when engaged on the tip, the conduit applies a force to the dispensing tip tending to close the valve; and (d) the first portion having at least two openings generally transversely disposed relative to the first end portion of the conduit means for providing access to opposite sides of the flexible conduit to facilitate connecting together the flexible conduit and dispensing tip of the pressurized mousse dispensing cylinder, and to provide access to the trigger mechanism of the cylinder to dispense mousse therefrom.

2. A device as claimed in claim 1, wherein connecting means includes an annular base of the first portion and a plurality of inwardly extending retaining projection of the annular base, the retaining projections being engageable with the pressurized mousse dispensing cylinder adjacent the dispensing tip.

3. A device as claimed in claim 2, wherein the first portion includes an upwardly tapering portion extending from the annular base, and the second portion includes a cylindrical portion extending from the upwardly tapering portion.

4. A device as claimed in claim 3, wherein the styling brush is hollow and adapted to slidably engage with the second portion and wherein the styling brush includes an opening, alignable with the dispensing aperture, so that the mousse can be dispensed from the device.

5. A device as claimed in claim 4, wherein the styling brush includes a locking cap to lock the styling brush onto the second portion of the body portion.

6. A device as claimed in claim 2 wherein the two openings for providing access include two arched access apertures extending upwardly from the annular base towards the second portion.

7. A device as claimed in claim 6, wherein there are three arched access apertures equidistantly spaced around the annular base.

8. A device as claimed in claim 1, wherein the angle is approximately 25° to the longitudinal axis of the body portion.

9. A device as claimed in claim 1, wherein the conduit means for receiving the mousse also includes a rigid conduit communicating with the dispensing aperture and the flexible conduit.

10. A device as claimed in claim 9, wherein the flexible conduit is connected to the rigid conduit to extend therefrom, and is preformed at an angle to the rigid conduit.

11. A device as claimed in claim 10, wherein the angle is approximately 25° to the rigid conduit which extends along the longitudinal axis of the device.

12. In combination, a hair brush/mousse dispensing device and a pressurized mousse dispensing cylinder, the cylinder having a generally axially aligned dispensing tip and a trigger mechanism adjacent a dispensing end of the cylinder, the trigger mechanism cooperating with a valve controlling flow from the cylinder so that swinging the tip to an inclined position opens the valve, the hair brush/mousse dispensing device comprising:

(a) a body portion having a first portion and a second portion, the first portion having a generally cylindrical side wall with an open end remote from the second portion and connecting means for releasably connecting the open end of the device to the dispensing end of the pressurized mousse dispensing cylinder, the second portion having a dispensing aperture and a passageway communicating therewith, the passageway being disposed generally axially of the device, (b) a styling brush including a plurality of spaced apart bristles, the styling brush being axially moveable relative to, and detachably mounted on the second portion of the body portion and communicating with the dispensing aperture, (c) conduit means for receiving the mousse, the conduit means having an elongated flexible conduit having an first end portion with a diameter which is releasably connected to the dispensing tip of the pressurized mousse dispensing cylinder, the conduit having an second portion connected to the passageway for communication with the dispensing aperture in the body portion, the flexible conduit being preformed to extend at an angle to the longitudinal axis of the body portion when disconnected from the dispensing tip, and, when engaged on the tip, the conduit applies a force to the dispensing tip tending to close the valve, and is sufficiently flexible to permit lateral movement thereof relative to the second portion in response to movement of the dispensing tip, and (d) the first portion having at least two openings generally transversely disposed relative to the first end portion of the conduit means for providing access to opposite sides of the flexible conduit to facilitate connecting together the flexible conduit and the dispensing tip of the pressurized mousse dispensing cylinder, and to provide access to the trigger mechanism of the cylinder to dispense mousse therefrom.

13. A combination as claimed in claim 12, wherein the connecting means includes an annular base of the first portion and a plurality of inwardly extending retaining projections on the annular base, the retaining projections engaging the pressurized mousse dispensing cylinder adjacent the dispensing tip.

14. A combination as claimed in claim 12, wherein the two openings for providing access include two arched access apertures extending from the annular base towards the second portion.

15. A combination as claimed in claim 12, wherein the conduit means for receiving the mousse also includes a rigid conduit communicating with the dispensing aperture and the flexible conduit.

16. A combination as claimed in claim 12, wherein the first end portion of the flexible conduit forms an angle of approximately 25° to the longitudinal axis when the flexible conduit is disconnected from the dispensing tip.

* * * * *